US010622710B2

(12) United States Patent
Lindenmeier et al.

(10) Patent No.: US 10,622,710 B2
(45) Date of Patent: Apr. 14, 2020

(54) PROTECTIVE ANTENNA COVER FOR VEHICLES

(71) Applicant: FUBA Automotive Electronics GmbH, Bad Salzdetfurth (DE)

(72) Inventors: Stefan Lindenmeier, Gauting-Buchendorf (DE); Heinz Lindenmeier, Planegg (DE)

(73) Assignee: FUBA AUTOMOTIVE ELECTRONICS GMBH (DE)

( * ) Notice: Subject to any disclaimer, the term of this patent is extended or adjusted under 35 U.S.C. 154(b) by 0 days.

(21) Appl. No.: 16/098,850

(22) PCT Filed: May 3, 2017

(86) PCT No.: PCT/EP2017/060477
§ 371 (c)(1),
(2) Date: Nov. 3, 2018

(87) PCT Pub. No.: WO2017/191161
PCT Pub. Date: Nov. 9, 2017

(65) Prior Publication Data

US 2019/0140345 A1 May 9, 2019

(30) Foreign Application Priority Data

May 4, 2016 (DE) ..... 10 2016 005 517
Aug. 22, 2016 (DE) ..... 10 2016 010 200

(51) Int. Cl.
*H01Q 1/32* (2006.01)
*H01Q 1/38* (2006.01)
*H01Q 1/40* (2006.01)
*H01Q 7/00* (2006.01)

(52) U.S. Cl.
CPC ..... *H01Q 1/3275* (2013.01); *H01Q 1/38* (2013.01); *H01Q 1/405* (2013.01); *H01Q 7/00* (2013.01)

(58) Field of Classification Search
CPC ..... H01Q 1/32; H01Q 1/325; H01Q 1/3275; H01Q 1/40; H01Q 1/405
See application file for complete search history.

(56) References Cited

FOREIGN PATENT DOCUMENTS

| | | | |
|---|---|---|---|
| DE | 102013005001 | A1 | 9/2014 |
| EP | 2424036 | A2 | 2/2012 |
| WO | 2010114336 | A2 | 10/2010 |

OTHER PUBLICATIONS

English Translation of International Search Report for International Application No. PCT/EP2017/060477, dated Jul. 26, 2017, 2 pages.
English Translation of Written Opinion for International Application No. PCT/EP2017/060477, dated Jul. 26, 2017, 5 pages.

*Primary Examiner* — Robert Karacsony
(74) *Attorney, Agent, or Firm* — Dickinson Wright PLLC

(57) ABSTRACT

A closed-loop radiator for receiving circularly polarized satellite radio signals underneath a shell-type protective antenna cover made of dielectric plastic comprises a closed-loop conductor and vertical radiators that are connected thereto; the closed-loop conductor and the vertical radiators are applied as a coating to the inner surface of the protective antenna cover and form an electrically conducting, interconnected antenna structure.

20 Claims, 8 Drawing Sheets b)

a)

PROTECTIVE ANTENNA COVER FOR VEHICLES

CROSS-REFERENCES TO RELATED APPLICATIONS

This patent application is a 371 of International Application No. PCT/EP2017/060477, filed May 3, 2017 which claims the priority of German Application No. 102016005517.0, filed May 4, 2016 and German Application No. 102016010200.4, filed Aug. 22, 2016, each of which are incorporated herein by reference in their entirety.

The invention relates to a protective antenna cover (ESD cover), for example in shell form, that is formed as a loop radiator and is in particular composed of dielectric plastic, for the reception of circularly polarized satellite radio signals.

Such a reception takes place in the example of SDARS satellite radio at a frequency of approximately 2.33 GHz having the free space wavelength A=12.8 cm in two adjacent frequency bands each having a bandwidth of 4 MHz at a spacing of the center frequencies of 8 MHz. The signals are irradiated from different satellites with an electromagnetic wave circularly polarized in one direction. Similar satellite radio systems are currently in planning. Circularly polarized antennas in the corresponding rotational direction are accordingly used for the reception. The satellites of the global positioning system (GPS) likewise radiate waves circularly polarized in one direction at the frequency of approximately 1575 MHz so that said antenna shapes can generally inter alia also be designed for this service.

Such antennas are preferably used on a vehicle roof for the mobile reception of circularly polarized satellite signals of the satellite radio services SDARS or XM or e.g. the GPS navigation system in vehicles. The metal vehicle roof here frequently serves as an expanded electrically conductive base surface for such antennas. Provision is likewise made to accommodate an antenna for the reception of circularly polarized satellite radio signals beneath a shell-shaped protective antenna cover composed of dielectric plastic. The opening side of the shell is here covered by an electrically conductive base plate that is mechanically connected to the protective antenna cover and that can be positioned with a substantially horizontal orientation on the outer skin of a motor vehicle.

Figure 1:
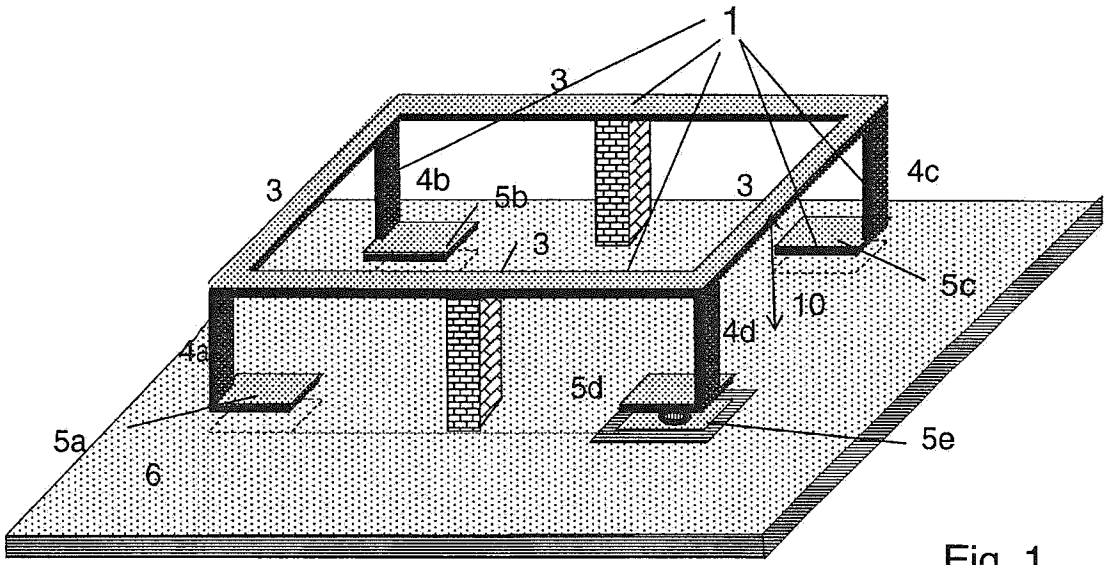
Fig. 1 Prior Art

Such a loop radiator is known from DE 10 2009 040 910 and is shown as prior art in FIG. 1. The loop radiator shown is cut from sheet metal and is subsequently brought into the shape shown by bending. The arrangement of such an antenna beneath a shell-shaped protective antenna cover composed of plastic material is known from DE 10 2013 005 001. The shell-shaped protective antenna cover serves as protection of the antenna both from moisture and from electrostatic discharge (ESD protection). The satellite antenna described there is of loop design and is fastened to the base plate that terminates the opening of the protective antenna cover. A similar kind of fastening on the base plate is typical on the use of patch antennas as circularly polarized satellite antennas.

The known satellite antenna shown in FIG. 1 comprises a loop radiator 1 that is formed by a closed loop 3 in particular arranged at a spacing $h<\lambda/10$ marked by reference numeral 10 and extending in parallel with a conductive base plate 6 and that has linear, substantially vertical radiators 4*a*-4*d* connected in distributed form to the periphery of the loop radiator 1 and extending toward the conductive base plate 6. At least one of the linear radiators is here connected at its lower end via a capacitor 5*a*-5*c* to the electrically conductive base plate 6 and another substantially vertical radiator 4*d* is connected via a capacitor 5*d* to an antenna connector 5*e*.

What is decisive for the acceptance of the technology of antenna for vehicles is, in addition to the functionality of the antenna, above all the economic effort that is associated both with the manufacture of the antenna and also with its implementation on the vehicle.

Due to the very tight tolerances in directional radiation patterns of satellite antennas, the tolerances for the manufacture of such antennas are extremely small. The observation of not only the mechanical dimensions, but also of the dielectric properties of the antenna body is equally a problem with circularly polarized antennas that work in accordance with a different principle of action such as patch antennas. In particular the observation of the mechanical dimensions is of special importance in the present loop radiator.

The storage of the loop radiator cut from sheet metal and subsequently bent as a mass produced product in mass production is also problematic. A storage of the sheet metal structure maintaining its shape is extremely complex and/or expensive and a harmful deformation of the structure by handing can only be avoided with great difficulty due to the tight tolerances.

These demands on the accuracy naturally result in increased manufacturing costs for the antennas.

The object is therefore associated with the present invention of designing an antenna for the reception of circularly polarized satellite radio signals that enables a simpler implementation on the vehicle with a high functional reliability and with a small economic effort.

This object is satisfied by the features of claim 1.

Advantageous embodiments of the invention are described in the dependent claims and in the description.

The protective antenna cover can be positioned above an electrically conductive base plate that is mechanically connected to it, that covers the opening of the protective antenna cover and that is to be positioned on an outer skin of a motor vehicle in a substantially horizontal orientation. The opening of the protective antenna cover can also be closed by a film or plate, that is in particular dielectric and that is in particular positioned in the reference plane.

The protective antenna cover can be provided with at least one loop radiator that is formed by a closed loop arranged extending at a spacing h in parallel with the conductive base plate and that has linear, substantially vertical, radiators connected distributed at the periphery of the loop and extending toward the conductive base plate. In this respect, a linear radiator or a vertical radiator is understood in accordance with the invention as a linear radiator that is connected to the loop and that does not necessarily extend away from the plane of the loop at an angle of 90°. The vertical radiators in accordance with the invention can rather also extend in the direction of the electrically conductive base plate or in the direction of the reference plane formed by the opening of the protective antenna cover at an angle differing from 90°. A linear radiator in accordance with the invention also does not necessarily have to have the shape of a straight line. The term linear radiator is rather seen in accordance with the invention as a delineation from the loop radiator that forms a closed (round or angled) loop shape. In contrast, the linear radiators in accordance with the invention extend away from the loop in the direction of the opening of the protective antenna cover. It is therefore understood that the linear radiators can also be formed as curved if the protective antenna cover, for example, has a dome-shaped design.

The protective antenna cover can generally be configured as desired, for example in a shell shape, a dome shape or a pyramid shape, or also as a combination of these shapes. The protective antenna cover, however, preferably has part surfaces at its inner side which are electrically conductively coated and whose shape is adapted to the function of the components of the loop radiator.

At least one of the linear radiators can be capacitively connected at its lower end via a capacitor to the electrically conductive base plate and another linear radiator can be capacitively connected via a capacitor to an antenna connector.

Individual features of the invention can be:

the loop radiator 1, comprising the loop 3 and linear or vertical radiators 4, 4*a-d* connected thereto and extending toward the conductive base plate 6 is applied in a coated manner as an electrically conductively contiguous antenna structure to the inner surface of the protective antenna cover 1*a*; and the contour of the inner surface of the shell-shaped protective antenna cover 1*a* is configured by the shaping of its inner surface for the design of the electrically conductively surfaces or strip-shaped conductor tracks 12 in a manner such that the closed loop extends as an electrically conductively coated surface in parallel with the conductive base plate 6 and the radiators 4, 4*a-d* that are substantially vertical toward the electrically conductive base plate 6 are formed on substantially vertical surfaces coated in an electrically conductively manner.

A particular advantage of the invention is given in that the dimensional stability can easily be observed due to the shape of the protective antenna cover 1*a* pressed into plastic. The properties of modern plastics in particular also have long term stability under extreme weather conditions. The conductive surfaces applied using modern laser technologies or printing techniques to the inner surfaces of the correspondingly preshaped shell-shaped protective antenna cover 1*a* thus have electrical properties that are constant in the long term. Laser techniques or printing techniques have already provided suitable for mass production. The printing of the electrically conductive layer can be implemented, for example, by a pressure pin for a direct application of the conductive layer or, for example, by a laser beam. The tip of the pressure pin or the diameter of the laser beam respectively determines the grain fineness of the print and thus the fineness of the structures to be designed.

On a use of a laser, the inner surface of the protective antenna cover can e.g. be covered over a larger area by an electrically conductive layer and above it by a laser-sensitive layer that hardens on exposure to laser light in a manner such that the electrically conductive layer below it and the non-exposed points of the conductive layer are removed in a subsequent etching process.

Finally, it is also possible on the presence of an electrically conductive layer applied over a large area to treat it with a high energy laser beam in a manner such that the non-conductive surface parts of the layer are "lasered free".

The required solid shape match between the protective antenna cover 1*a* and the conductive surface 6 can always be established. The complexity in the manufacture of known loop radiators 1 cut from sheet material, subsequently bent, stored in a manner suitable for its shape, and mounted on the conductive base plate 6 in a manner suitable for its shape is extremely reduced with a loop radiator in accordance with the invention.

The capacitors 5*a*, 5*b*, 5*c*, 5*d* can each be formed in pairs disposed opposite one another by a flat electrode 5*a*, 5*b*, 5*c*, 5*d* and a flat counter-electrode respectively in parallel therewith. A respective flat electrode 5*d* that is connected to the lower end of the respective substantially vertical radiator 4*d* is here applied in a coated manner as an electrically conductive areal structure to a formation of the inner surface of the protective antenna cover 1*a* formed extending at a spacing 11 from and in parallel with the conductive base plate 6. The capacitance value of the capacitors is determined by the spacing 11.

With a loop radiator 1 in accordance with the prior art in FIG. 1, the observation of the capacitance values by the electrodes 5*a*, 5*b*, 5*c*, 5*d* is of great importance with respect to the antenna impedance and to the radiation pattern. In the invention, the ensuring required for this purpose of the correct spacing (11) (see FIG. 2*c*) of the electrodes 5*a*, 5*b*, 5*c*, 5*d* from the conductive base surface 6 or from the counter-electrode forming the antenna connector 5 is provided in a simple manner by the dimensional stability of the protective antenna cover 1*a*. The coating of the correspondingly shaped inner side of the protective antenna cover 1*a* can take place with extreme time efficiency using modern methods and the manufacture of the satellite antenna can take place with a few hand movements by applying the protective antenna cover 2*a* to the electrically conductive base surface 6. A great advantage of the present invention is in particular shown here.

For the capacitive connection of the at least one of the substantially vertical radiators 4, 4*a-d* at its lower end to the antenna connector 5 in the plane of the base plate 6, a flat counter-electrode 5*e* electrically insulated therefrom is formed that is connected to the antenna connector 5.

Figure 4:
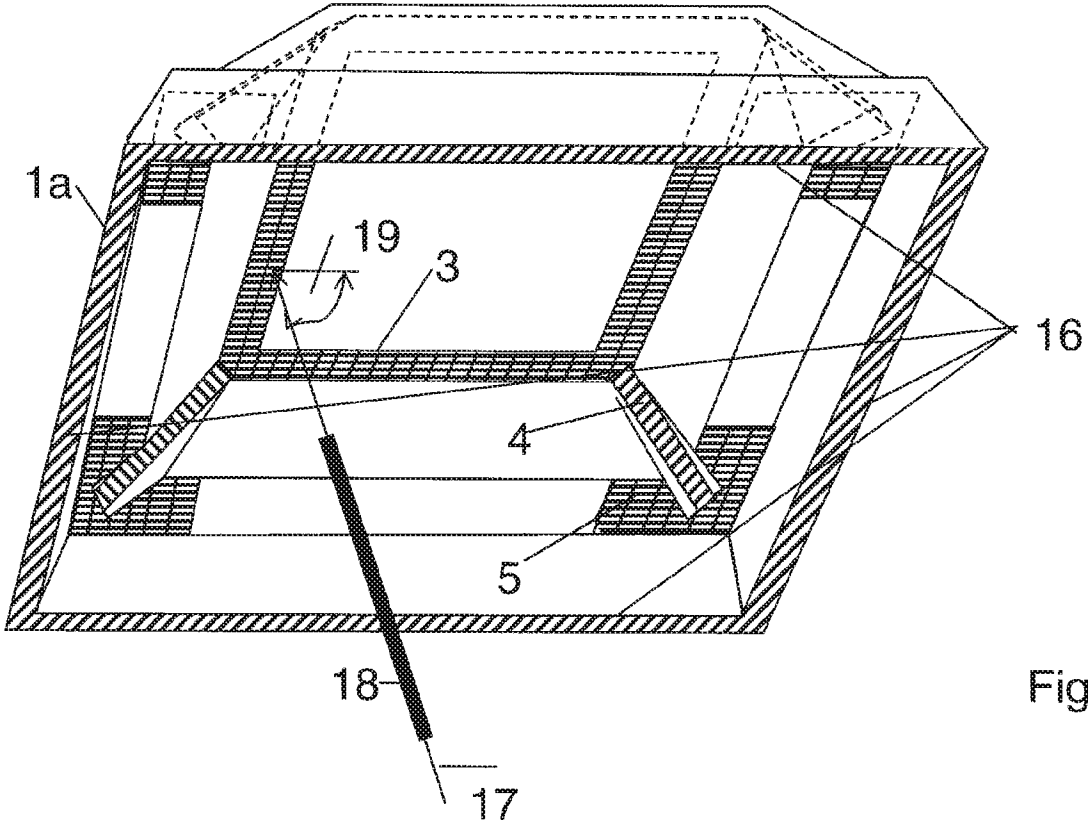

The marginal line of the opening of the shell-shaped protective antenna cover 1*a* and the conductive base surface 6 extend in a plane that is defined for the following description in a horizontal location as the reference plane 16 (FIG. 4). The protective antenna cover 1*a* thus extends above this reference plane 16.

To ensure an error-free mold removal on the pressing of the shell-shaped cover, all the flat parts disposed in the interior of the shell-shaped protective antenna cover 1*a* and all the flat parts disposed on the outer surface of the shell-shaped protective antenna cover 1*a* can adopt an angle toward the horizontal reference plane 16 of no more than 89.5% as the mold removal slope.

In a manufacturing method, the coating of all the surfaces to be electrically conductively coated can take place with the aid of a needle-shaped jet producing the coating from only one direction (=processing direction 17) that extends substantially perpendicular to the reference plane 16. All the surfaces disposed in the interior of the shell-shaped protective antenna cover and to be coated can adopt a so-called coating angle 19 with respect to this processing direction 17 of at least 5° to ensure a coating that can have sharp contours.

Furthermore, in a manufacturing method, the surfaces of horizontal parts of the loop radiator to be electrically conductively coated and optionally also the capacitance electrodes can each be disposed in parallel with the reference plane 16 and substantially perpendicular to the processing direction 17. The surfaces to be electrically conductively coated of the substantially vertical radiators can adopt a coating angle 19 with respect to the processing direction 17 of at least 5°, in particular of more than 45°, to ensure a coating having sharp contours.

The shell-shaped protective antenna cover 1*a* can furthermore have the shape of a stepped pyramid hollowed out from below whose lower side walls lie on the electrically conductive base surface, with the cover having two substantially horizontal part surfaces that are in parallel with this base surface and located above it, that are substantially horizontal, and that are in the form of a first peripheral step, and with the cover having a substantially planar top surface thereabove.

In accordance with the invention, four capacitance electrodes can be located in four respective corners on the lower side of a horizontal part surface of a peripheral step.

The loop 3 can—in an advantageous embodiment of the invention—be located at the lower side of an upper top surface, in particular in the extent of the contour of this top surface.

The four capacitance electrodes 5*a*, 5*b*, 5*c*, 5*d* can each be connected to a corner of the loop 3 above it via a respective substantially vertical radiator 4, 4*a-d*.

The protective antenna cover 1*a*, in particular of shell shape, can be structured in an advantageous embodiment of the invention in the form of a truncated pyramid that is hollowed out from below and that comprises four side walls and a top surface, with these side walls lying on the electrically conductive base surface and with the loop 3 being located at the lower side of the top surface in the extent following the contour of this top surface.

In an advantageous embodiment of the invention, the loop 3 can be respectively connected at each of its four corners to a substantially vertical radiator 4, 4*a-d* that respectively leads, starting from the respective corner, along the inner edge between side walls contacting the corner until it ends at a spacing 11 from the base surface 6.

The vertical radiators 4, 4*a-d*, can be respectively connected at a spacing 11 from the base surface to a capacitance electrode 5*a*, 5*b*, 5*c*, 5*d* that is designed by formation at the respective corner in the form of a horizontal surface that extends at a spacing 11 in parallel with the base surface 6 and that is produced by a gradation of the inner side of the side walls.

The surfaces to be electrically conductively coated can be structured in the form of electrically conductive lattice structures whose mesh is in particular substantially smaller than ⅛ of the wavelength.

Figure 2:
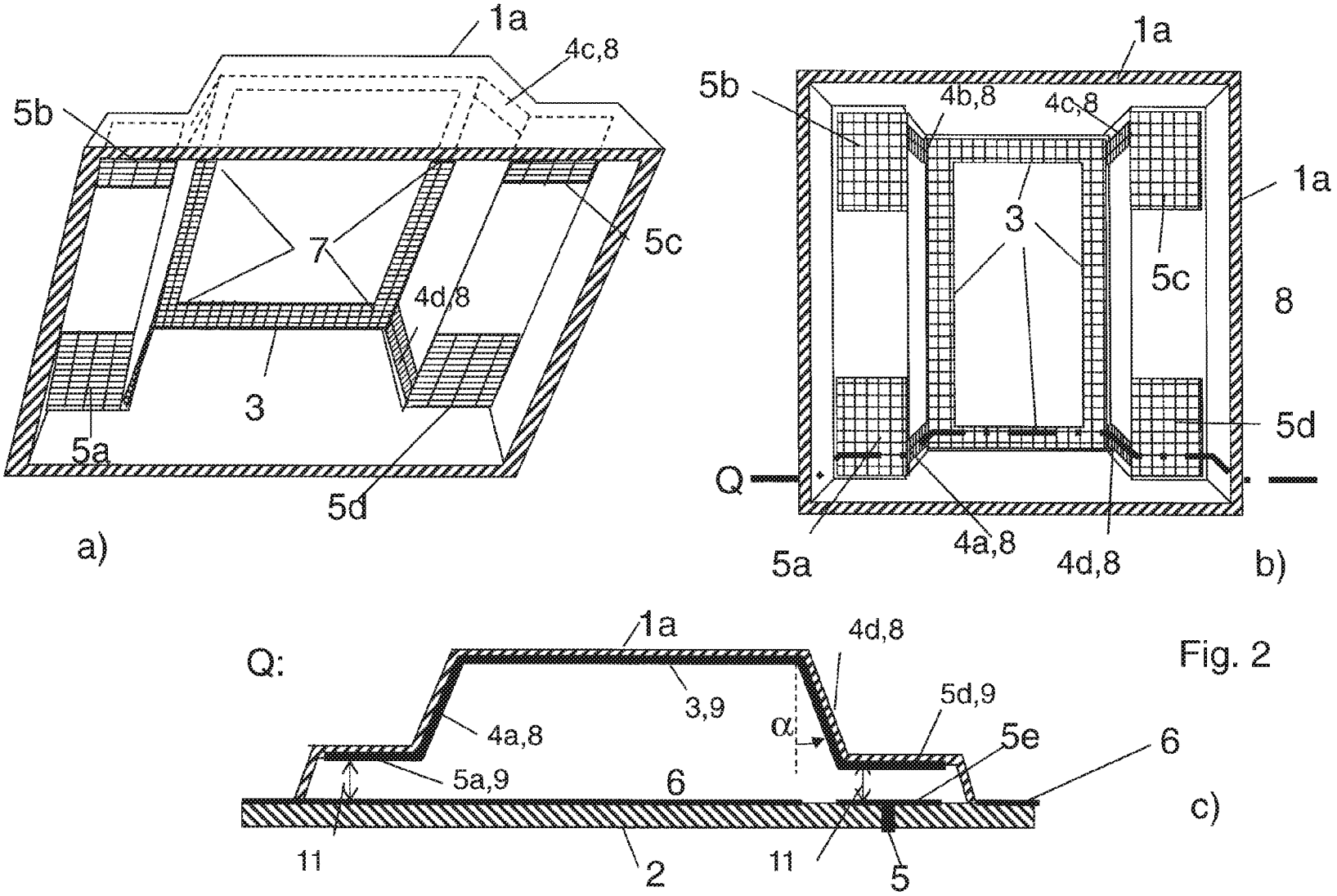
Figure 3:
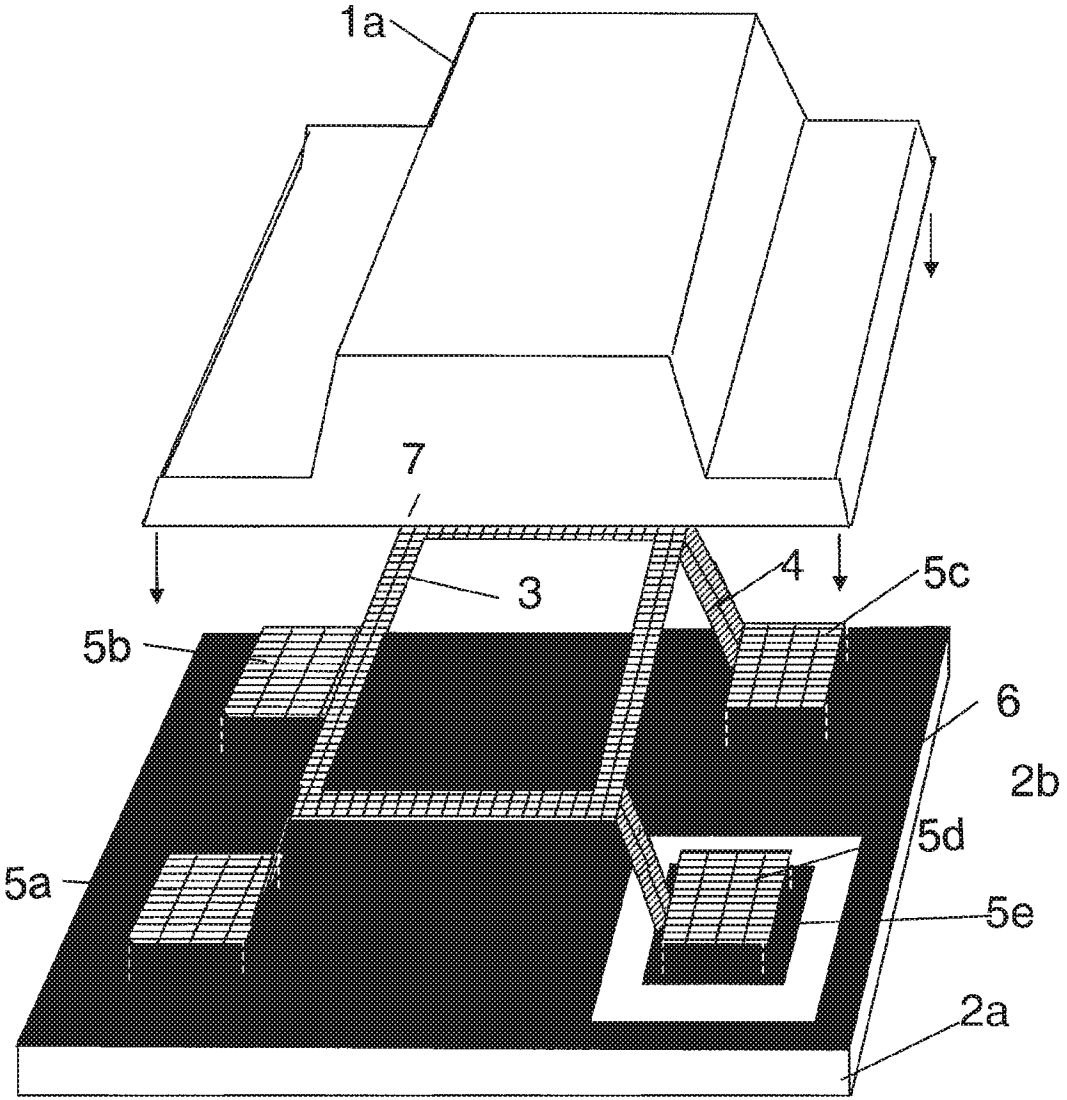

The invention will be explained in more detail in the following with reference to embodiments. The associated Figures show in detail:

FIG. 1 a loop radiator 1 in accordance with the prior art with vertical radiators 4, 4*a-d* and capacitors 5*a-d* at their lower ends, e.g. as a sheet metal structure with a holder on plastic supports;

FIG. 2 a) a loop radiator as an electrically conductive coating on the inner surface of a shell-shaped protective antenna cover 1*a* composed of a dielectric plastic in accordance with the invention. The oblique view of the inner space of the protective antenna cover 1*a* shows the coated surfaces as net structures. The boundary on the lower side of the protective antenna cover 1*a* (hatched) extends in a plane (reference plane 16) for connection to the electrically conductive base surface 6 in the final assembly. The loop 3 and the electrodes 5*a-d* of the capacitors at the lower ends of the substantially vertical radiators 4*a-d* are applied to horizontal surface parts of the correspondingly shaped protective antenna cover 1*a* as a conductive coating;

b) a loop radiator as an electrically conductive coating on the inner surface of a shell-shaped protective antenna cover 1*a* as in a), but with a view of the inner space from below. The chain dotted line Q describes the view of the cross-section Q. of the arrangement shown in FIG. 1*c*); and c) the cross-sectional drawing shows the spacing 11 between the capacitance electrodes 5*a*, 5*b*, 5*c*, 5*d* and the electrically conductive base surface 6 or the counter-electrode for forming the antenna connector 5*e*. The observation of the required capacitance values with the aid of the consistency of this spacing 11 is given by the dimensionally stable shape of the protective antenna cover 1*a* and by its temporal durability. The angle of inclination a of the substantially vertical inner surfaces of the protective antenna cover 1 with respect to the line perpendicular to the conductive base surface 6 can amount to at least 5° and should not fall below the coating angle 19 with a processing direction 17 in parallel with the latter (FIG. 4);

FIG. 3 an exploded drawing to represent the loop radiator fictionally released from the protective antenna cover 1*a* and having the loop 3 and the vertical radiators 4 as electrically conductive surfaces (lattice network) above an electrically conductive base surface 6 shown as an electrically conductively coated circuit board 2. The capacitance electrode 5*d* is capacitively coupled to the antenna connector 5*e* via the insulated conductive surface formed as a counter-electrode on the coated circuit board that forms said antenna connector 5*e;*

Figure 5:
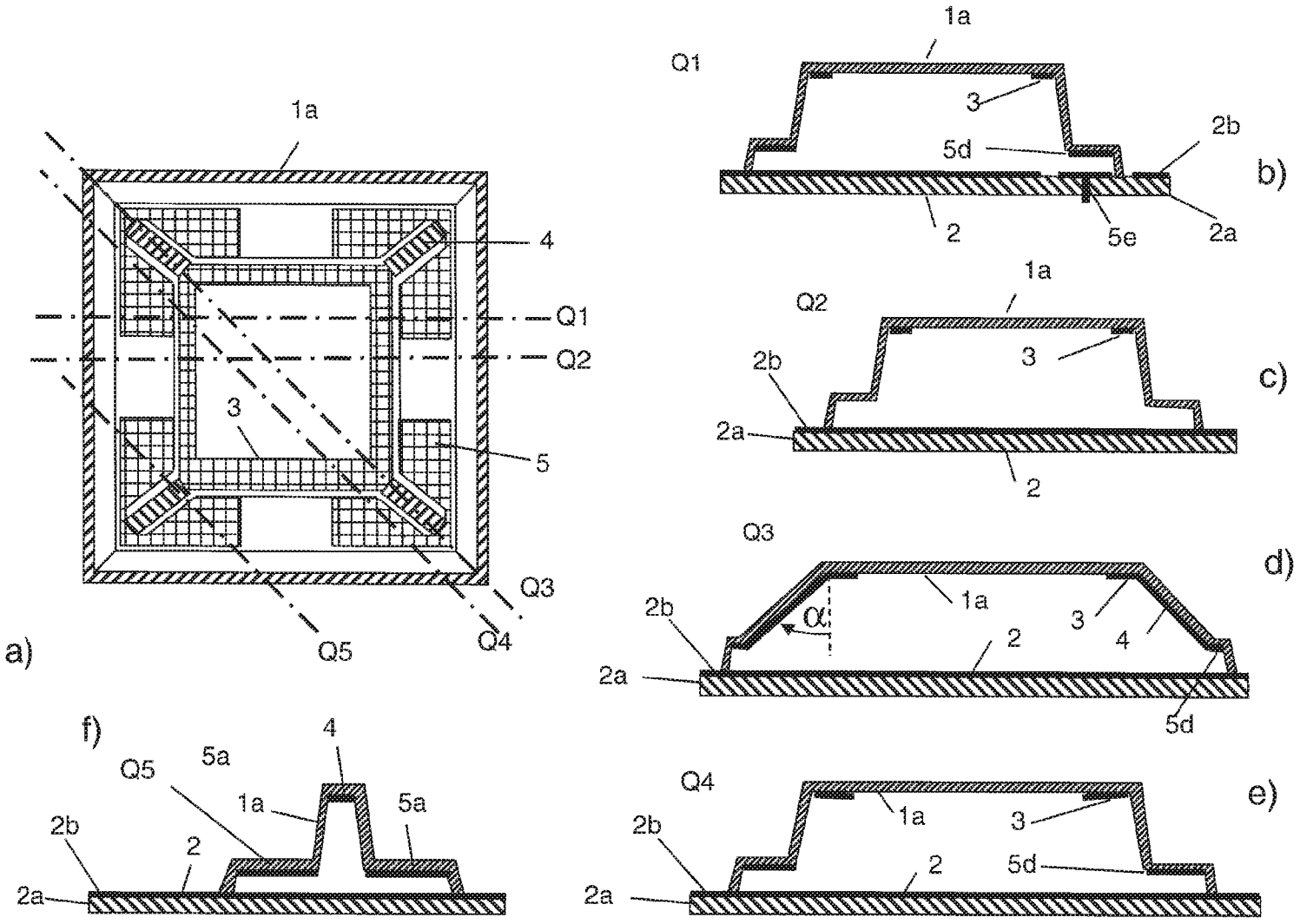
Figure 6:
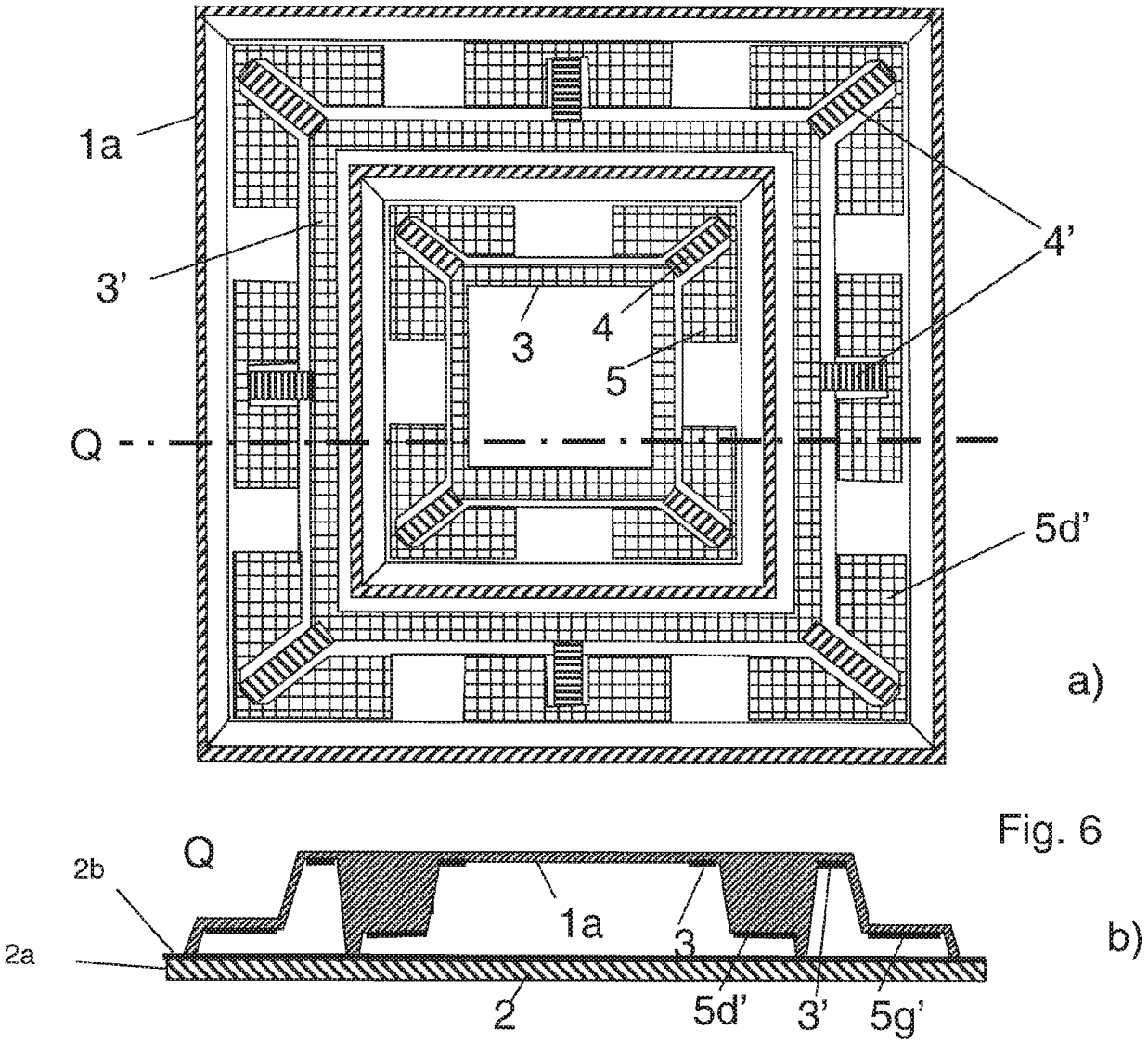
Figure 7:
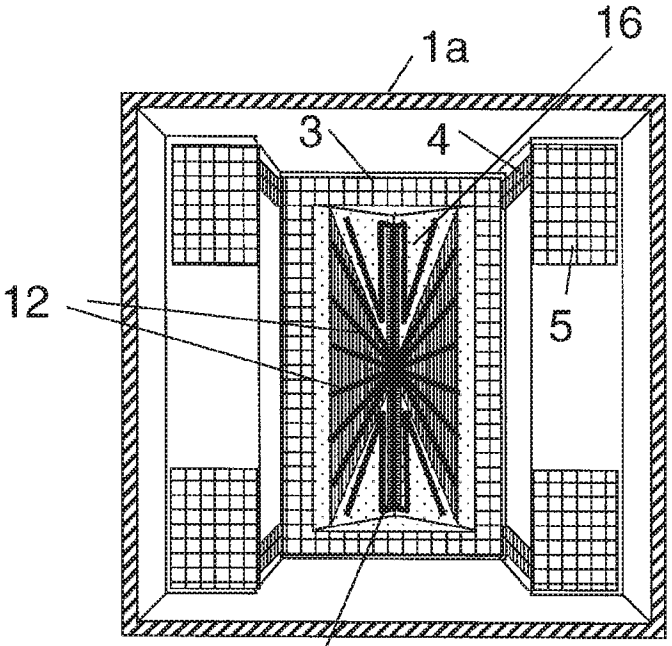
Figure 7:
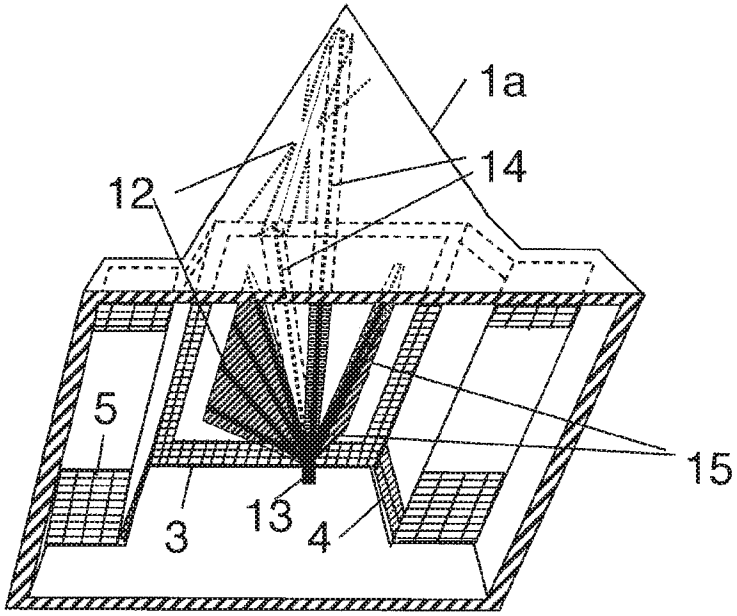
Figure 8:
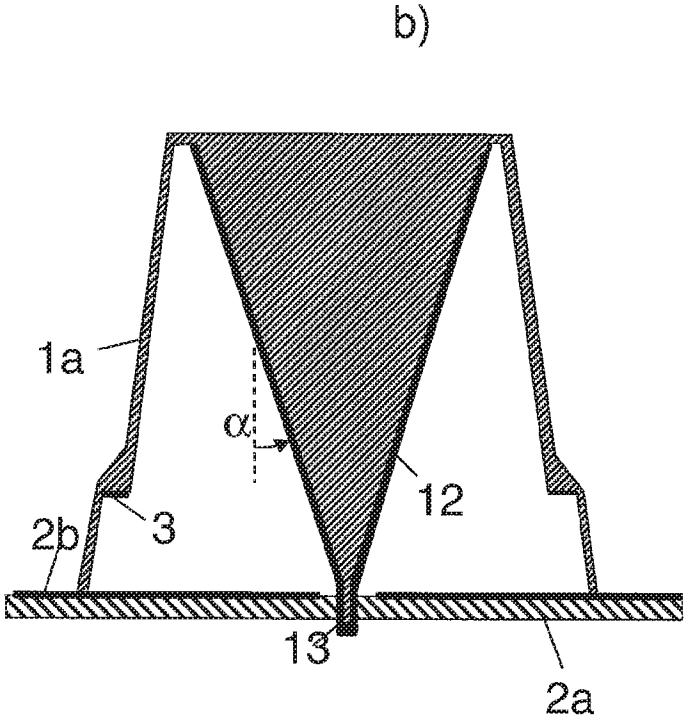
Figure 8:
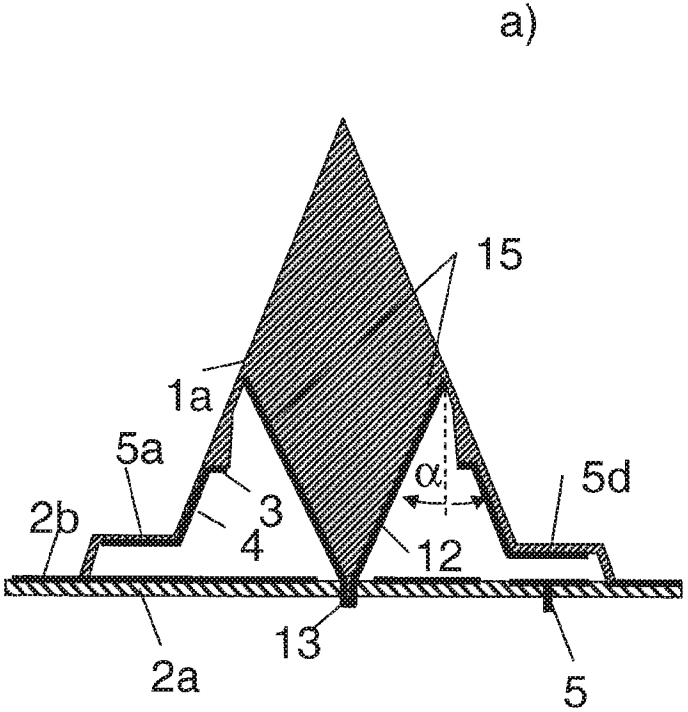

FIG. 4 a protective antenna cover 1*a* with an electrically conductive coating as a loop antenna in accordance with the invention with a view obliquely from below into the opening of the protective antenna cover. The protective antenna cover is configured in the form of a pyramid that is hollowed out from the bottom, is truncated, and is in particular stepped. Care has been taken here that this shape can be manufactured in a simple injection molding technique. The surfaces marked as a lattice network show the elements of the loop radiators in this projection. The shell margins extend in the above-named reference plane 16. An elongated coating device 18 that can, for example, be implemented as a pressure pin for a direct printing of the conductive layer or, for example, also as a laser beam can be present for the printing, in particular to be carried out in dot form, of an electrically conductive layer. The tip of the pressure pin or the diameter of the laser beam respectively determines the grain fineness of the print and thus the fineness of the structures to be designed. The coating device 18 is aligned in the processing direction 17. The coating angle 19 between this direction 17 and the surface to be printed is selected as at least 5° to ensure a coating with a sharp contour;

FIG. 5 a) a view from below into the opening of the protective antenna cover 1*a* with an electrically conductive coating as a loop radiator in accordance with FIG. 4. The chain dotted lines Q1 to 05 show the line for the representation of the corresponding cross-sections in the following Figures b) to e);

b) the representation of the cross-section in accordance with the line Q1 shows the steep side walls of the pyramid that extend, for example, at an angle of less than 90° and greater than 75° to the reference plane 16. In this position, the capacitance electrodes 5*b* (bottom left) and 5*c* (bottom right) and the counter-electrodes are shown that are formed by the electrically conductive base surface 6, on the one hand, and by the antenna connector 5*e*, on the other hand;

c) a representation of the cross-section in accordance with the line Q2 analog to b). The capacitance electrodes are not affected here;

d) a representation of the cross-section in accordance with the line Q3. The vertical radiators 4, 4*a-d* are inclined at an angle α toward the reference line perpendicular to the base surface 6 that can amount to between 0° and 70°;

e) a representation of the cross-section in accordance with the line Q4; and f) a representation of the cross-section in accordance with the line Q5;

FIG. 6 an exemplary embodiment of two loops 3 and 3' having a common center, applied to the protective antenna cover 1*a*, that is designed in a similar manner as in FIGS. 4 and 5 as a truncated pyramid hollowed out from below. The representation shows in an advantageous embodiment of the invention the view of the protective antenna cover are marked by a lattice network of both the inner and outer loop radiators 3, 3'. Both loop radiators can e.g. be respectively designed by a suitable dimensioning of the loop 3 and 3' respectively and of the capacitors for the same frequency for the combined use of antenna diversity technologies. In this respect, the inner loop radiator is designed as a 1st order radiator, i.e. for an azimuthal phase distribution of 2π over a revolution, and the outer loop radiator is designed as a 2nd order radiator, i.e. for an azimuthal phase distribution of 2*2π over a revolution. In an advantageous embodiment of the invention, the outer loop radiator can equally be equipped for the reception of a further satellite radio service at a lower frequency than that of the inner loop radiator having only four vertical radiators 4';

FIG. 7 in a further advantageous embodiment of the invention, the loop radiator is combined with a terrestrial broadband communication antenna 15, for example for LTE communication, and with a terrestrial reception antenna 14, for example for AM/FM/DAB radio reception. The special advantage of the combination shown comprises the complete electromagnetic decoupling of the terrestrial antennas from the loop radiator 1 for satellite reception;

a) the advantageous combination capability of the terrestrial antennas with a common terrestrial antenna connector 13 at the center of the loop radiator can be seen from the view of the protective antenna cover 1*a* in FIG. 7*a* obliquely from below. The terrestrial broadband communication antenna 15 is substantially formed from strip-shaped electrically conductive conductor tracks 12 that converge at the terrestrial antenna connector point 13 and that are lasered or printed on surfaces formed in V shape on the designed in a similar manner by strip-shaped electrically conductive conductor tracks 12 printed or lasered on with the common antenna connector point 13; and b) shows this arrangement with a view from below from which the combination of the terrestrial reception antenna 14—at whose upper end an end capacitor 16 is formed—with the broadband communication antenna 15 can be seen;

FIG. 8 protective antenna covers 1*a* are used for the application of such antennas on a vehicle roof whose width is smaller transversely to the direction of travel than longitudinally to the direction of travel for technical flow reasons;

a) a representation of the exemplary design of the cross-section of a protective antenna cover 1*a* in accordance with the invention (transversely to the direction of travel) with the surfaces electrically conductively coated with strip shaped conductor tracks 12 for the loop radiator and the terrestrial broadband communication antenna 15. These conductor tracks are in particular angled in a V shape in the plane transversely to the direction of travel. It is advantageous for a high quality coating of the protective antenna cover 1*a* from below from the direction of the perpendicular dashed line not to fall below the coating angle 19 of α=5° between this line and the surface to be coated at any point; and b) the strip shaped conductor tracks 12 of the terrestrial reception antenna 14 that is higher in comparison with the broadband communication antenna 15 is shown in the representation of a section of the protective antenna cover 1*a* in accordance with the invention along the direction of travel. These conductor tracks 12 are, in contrast to those of the broadband communication antenna 15, angled in V shape in the plane along the direction of travel. Both antennas meet in the common terrestrial antenna connector point 13.

Advantageous embodiments of the invention are shown again in the following:

1. A protective antenna cover (1*a*) composed of dielectric plastic is defined as a loop radiator for the reception of circularly polarized satellite radio signals whose opening defines a reference plane (16), comprising a loop (3, 3') and at least one linear radiator (4, 4*a-d*) connected thereto and extending in the direction of the reference plane (16), wherein the loop (3) and the linear radiator (4, 4*a-d*) are applied to the inner surface of the protective antenna cover (1*a*) as a coating and form an electrically conductive and contiguous antenna structure.

2. A protective antenna cover in accordance with example 1, characterized in that
the contour of the inner surface of the contour (1*a*) is configured by shaping the inner surface of the protective antenna cover (1*a*) for a design of electrically conductive surfaces in a manner such that the loop (3, 3') is formed on a surface in parallel with the reference plane (16).

3. A protective antenna cover in accordance with example 1 or example 2,
characterized in that
the linear radiator (4, 4*a-d*) extending toward the reference plane (16) is formed by an electrically conductively coated strip surface.

4. A protective antenna cover in accordance with at least one of the preceding examples,
characterized in that
a flat capacitance electrode (5*a* 5*b*, 5*c*, 5*d*) is applied in a coated manner as an electrically conductive areal structure on a formation of the inner surface of the protective antenna cover (1*a*) formed in parallel with and at a spacing (11) from the reference plane (16) and is electrically conductively connected to the lower end of the linear radiator (4, 4*a-d*).

5. A protective antenna cover in accordance with at least one of the preceding examples,
characterized in that
a counter-electrode is formed by an electrically conductive base plate (6) at the lower end of the at least one linear radiator (4, 4*a-d*) to connect said at least one linear radiator (4, 4*a-d*) to said electrically conductive base plate (6).

6. A protective antenna cover in accordance with at least one of the preceding examples,
characterized in that an areal counter-electrode (5*e*) that is connected to an antenna connector (5) is formed that is electrically insulated from an electrically conductive base plate (6) for the capacitive connection of a lower end of a linear radiator (4, 4*a-d*) to an antenna connector (5) in the plane of the electrically conductive base plate (6).

7. A protective antenna cover in accordance with at least one of the preceding examples,
characterized in that
all flat parts disposed on an outer surface and all flat parts disposed on the inner surface of the protective antenna cover (1*a*) adopt an angle to a common horizontal reference plane (16) of no more than 89.5°.

8. A protective antenna cover in accordance with at least one of the preceding examples,
characterized in that
it has the shape of an internally hollow stepped pyramid, at least in the interior, whose lower side walls are adjacent to the reference plane (16), with the stepped pyramid having in parallel with the reference plane (16) two substantially horizontal part surfaces located thereabove in the form of a first peripheral step and a planar top surface disposed thereabove, and with in particular four capacitance electrodes (5*a*, 5*b*, 5*c*, 5*d*) being located at the lower side of the lower horizontal part surface, in each case in its four corners, and/or with the loop (3) being located at the lower side of the upper top surface.

9. A protective antenna cover in accordance with at least one of the preceding examples,
characterized in that
four capacitance electrodes (5*a*, 5*b*, 5*c*, 5*d*) are each connected via a respective linear radiator (4*a*, 4*b*, 4*c*, 4*d*) to a corner of the loop (3, 3') disposed thereabove.

10. A protective antenna cover in accordance with at least one of the preceding examples,
characterized in that
it has the shape of a truncated pyramid, at least in the interior, that has four side walls and a top surface, with the side walls being adjacent to the reference plane (16).

11. A protective antenna cover in accordance with at least one of the preceding examples,
characterized in that
the loop (3, 3') is connected at each of its four corners to a respective linear radiator (4*a*, 4*b*, 4*c*, 4*d*) that leads, respectively starting from the respective corner, along an inner edge between side walls contacting the corner until it ends at a spacing (11) from the reference plane (16).

12. A protective antenna cover in accordance with at least one of the preceding examples,
characterized in that
a plurality of vertical radiators (4*a*, 4*b*, 4*c*, 4*d*) are connected at a spacing (11) from the reference plane (16) to a respective capacitance electrode (5*a*, 5*b*, 5*c*, 5*d*) that is configured at a respective corner of the protective antenna cover (1*a*) in the form of a horizontal surface extending at a spacing (11) from and in parallel with the reference plane (16) and being formed by a gradation of the lower side of the side walls.

13. A protective antenna cover in accordance with at least one of the preceding examples,
characterized in that
the electrically conductive coating is applied at least partly in the form of an electrically conductive lattice structure whose mesh is in particular essentially smaller than ⅛ of the wavelength.

14. A protective antenna cover in accordance with at least one of the preceding examples,
characterized in that
the loop radiator is combined with at least one terrestrial vertical antenna (14, 15) for further radio services having a terrestrial antenna connector point (13) at the center of the loop (3, 3').

15. A protective antenna cover in accordance with at least one of the preceding examples,
characterized in that
two terrestrial antennas having a common terrestrial antenna connector point (13) at the center of the loop (3, 3') are present in it, of which the one is provided as a terrestrial broadband communication antenna (15) for LTE communication and the other terrestrial reception antenna (14) is provided for the coverage of frequency bands at a lower frequency such as LTE communication in the low band or AM/FM/DAB radio reception.

16. A protective antenna cover in accordance with example 15,
characterized in that
both terrestrial antennas are formed from strip-shaped and electrically conductive conductor tracks (12) that converge cluster-like at the antenna connector point (13) and that are formed from surfaces formed in V shape in the interior of the protective antenna cover (1*a*).

17. A protective antenna cover in accordance with at least one of the preceding examples,
characterized in that
the electrically conductive antenna structure is printed onto the inner jacket surface of the protective antenna cover or is applied using a laser.

18. A protective antenna cover in accordance with at least one of the preceding examples,
characterized in that
it has a greater extent in a first direction (direction of travel) in the reference plane than in a second direction extending transversely thereto; and in that conductor tracks (12) of a terrestrial broadband communication antenna (15) are angled out of a plane extending in the first direction and conductor tracks (12) of a higher terrestrial reception antenna (14) are angled out of a plane extending in the first direction.

19. A method of manufacturing a protective antenna cover in accordance with at least one of the preceding examples,
characterized in that
the production of the antenna structure takes place in the interior of the protective antenna cover (1*a*) from a direction (17) that extends substantially perpendicular to the reference plane (16).

20. A method in accordance with claim 19,
characterized in that
the antenna structure is printed or is generated with the aid of a laser on the inner side of the protective antenna cover (1*a*).

21. A method in accordance with example 19 or example 20,
characterized in that
the direction (17) has an angle (19) of at least 5° with respect to all the surfaces to be provided with the antenna structure.

REFERENCE NUMERAL LIST

1 loop radiator
1*a* protective antenna cover

2 electrically conductively coated circuit board
3 loop
4, 4*a*, 4*b*, 4*c*, 4*d* vertical radiators
5*a*, 5*b*, 5*c*, 5*d* capacitance electrodes
5, 5*e* antenna connector
6 conductive base surface
7, 7*a*, 7*b*, 7*c*, 7*d* loop coupling points
8 vertical parts
9 horizontal parts
10 spacing of the height h
11 spacing
12 strip shaped conductor tracks
13 terrestrial antenna connector point
14 terrestrial reception antenna
15 terrestrial broadband communication antenna
16 reference plane
17 processing direction
18 coating apparatus
19 coating angle

The invention claimed is:

1. A protective antenna cover composed of dielectric plastic formed as a loop radiator for the reception of circularly polarized satellite radio signals whose opening defines a reference plane, the protective antenna cover comprising a loop and at least one linear radiator connected thereto and extending in the direction of the reference plane, wherein the loop and the linear radiator are applied to the inner surface of the protective antenna cover as a coating and form an electrically conductive and contiguous antenna structure.

2. The protective antenna cover in accordance with claim 1, wherein the contour of the inner surface of the contour is configured by shaping the inner surface of the protective antenna cover for a design of electrically conductive surfaces in a manner such that the loop is formed on a surface in parallel with the reference plane.

3. The protective antenna cover in accordance with claim 1, wherein the linear radiator extending toward the reference plane is formed by an electrically conductively coated strip surface.

4. The protective antenna cover in accordance with claim 1, wherein a flat capacitance electrode is applied in a coated manner as an electrically conductive areal structure on a formation of the inner surface of the protective antenna cover formed in parallel with and at a spacing from the reference plane and is electrically conductively connected to the lower end of the linear radiator.

5. The protective antenna cover in accordance with claim 1, wherein a counter-electrode is formed by an electrically conductive base plate at the lower end of the at least one linear radiator to connect said at least one linear radiator to said electrically conductive base plate.

6. The protective antenna cover in accordance with claim 1, wherein an areal counter-electrode that is connected to an antenna connector is formed that is electrically insulated from an electrically conductive base plate for the capacitive connection of a lower end of a linear radiator to the antenna connector in the plane of the electrically conductive base plate.

7. The protective antenna cover in accordance with claim 1, wherein all flat parts disposed on an outer surface and all flat parts disposed on the inner surface of the protective antenna cover adopt an angle to a common horizontal reference plane of no more than 89.5°.

8. The protective antenna cover in accordance with claim 1, wherein the protective antenna cover has the shape of one of an internally hollow stepped pyramid, at least in the interior, whose lower side walls are adjacent to the reference plane, with the stepped pyramid having in parallel with the reference plane two substantially horizontal part surfaces located thereabove in the form of a first peripheral step and a planar top surface disposed thereabove, and an internally hollow stepped pyramid, at least in the interior, whose lower side walls are adjacent to the reference plane, with the stepped pyramid having in parallel with the reference plane two substantially horizontal part surfaces located thereabove in the form of a first peripheral step and a planar top surface disposed thereabove, and with four capacitance electrodes being located at the lower side of the lower horizontal part surface, in each case in its four corners, and/or with the loop being located at the lower side of the upper top surface.

9. The protective antenna cover in accordance with claim 1, wherein four capacitance electrodes are each connected via a respective linear radiator to a corner of the loop disposed thereabove.

10. The protective antenna cover in accordance with claim 1, wherein the protective antenna cover has the shape of a truncated pyramid, at least in the interior, that has four side walls and a top surface, with the side walls being adjacent to the reference plane.

11. The protective antenna cover in accordance with claim 1, wherein the loop is connected at each of its four corners to a respective linear radiator that leads, respectively starting from the respective corner, along an inner edge between side walls contacting the corner until it ends at a spacing from the reference plane.

12. The protective antenna cover in accordance with claim 1, wherein a plurality of vertical radiators are connected at a spacing from the reference plane to a respective capacitance electrode that is configured at a respective corner of the protective antenna cover in the form of a horizontal surface extending at a spacing from and in parallel with the reference plane and being formed by a gradation of the lower side of the side walls.

13. The protective antenna cover in accordance with claim 1, wherein the electrically conductive coating is applied at least partly in the form of one of an electrically conductive lattice structure, and an electrically conductive lattice structure whose mesh is smaller than ⅛ of the wavelength.

14. The protective antenna cover in accordance with claim 1, wherein the loop radiator is combined with at least one terrestrial vertical antenna for further radio services having a terrestrial antenna connector point at the center of the loop.

15. The protective antenna cover in accordance with claim 1, wherein two terrestrial antennas having a common terrestrial antenna connector point at the center of the loop are present, of which one is provided as a terrestrial broadband communication antenna for LTE communication and the other terrestrial reception antenna is provided for the coverage of frequency bands at a lower frequency.

16. The protective antenna cover in accordance with claim 15, wherein both terrestrial antennas are formed from strip-shaped and electrically conductive conductor tracks that converge cluster-like at the antenna connector point and that are formed from surfaces formed in V shape in the interior of the protective antenna cover.

17. The protective antenna cover in accordance with claim 1, wherein the electrically conductive antenna structure is printed onto the inner jacket surface of the protective antenna cover or is applied using a laser.

18. The protective antenna cover in accordance with claim 1, wherein the protective antenna cover has a greater extent in a first direction in the reference plane than in a second direction extending transversely thereto; and wherein conductor tracks of a terrestrial broadband communication antenna are angled out of a plane extending in the first direction and conductor tracks of a higher terrestrial reception antenna are angled out of a plane extending in the first direction.

19. A method of manufacturing a protective antenna cover composed of dielectric plastic formed as a loop radiator for the reception of circularly polarized satellite radio signals whose opening defines a reference plane, the protective antenna cover comprising a loop and at least one linear radiator connected thereto and extending in the direction of the reference plane, wherein the loop and the linear radiator are applied to the inner surface of the protective antenna cover as a coating and form an electrically conductive and contiguous antenna structure, wherein the production of the antenna structure takes place in the interior of the protective antenna cover from a direction that extends substantially perpendicular to the reference plane.

20. The method in accordance with claim 19, wherein the antenna structure is printed or is generated with the aid of a laser on the inner side of the protective antenna cover; and/or wherein the direction has an angle of at least 5° with respect to all the surfaces to be provided with the antenna structure.

* * * * *